US012195217B2

(12) United States Patent
Sthaalros et al.

(10) Patent No.: US 12,195,217 B2
(45) Date of Patent: Jan. 14, 2025

(54) WEB OF BAGS WITH GUIDE AND BAGS OF DIFFERENT MATERIALS

(71) Applicant: SCHUR TECHNOLOGY, Horsens (DK)

(72) Inventors: Ulrik Sthaalros, Horsens (DK); Henrik Käehne Rasmussen, Middelfart (DK); Bent Anthonsen-Rahbek, Juelsminde (DK); Henrik Pape, Horsens (DK)

(73) Assignee: SCHUR TECHNOLOGY A/S, Horsens (DK)

( * ) Notice: Subject to any disclaimer, the term of this patent is extended or adjusted under 35 U.S.C. 154(b) by 11 days.

(21) Appl. No.: 18/020,978

(22) PCT Filed: Aug. 13, 2021

(86) PCT No.: PCT/DK2021/050259
§ 371 (c)(1),
(2) Date: Feb. 13, 2023

(87) PCT Pub. No.: WO2022/033647
PCT Pub. Date: Feb. 17, 2022

(65) Prior Publication Data

US 2023/0294861 A1 Sep. 21, 2023

(30) Foreign Application Priority Data

Aug. 14, 2020 (DK) ..... BA 2020 00077
Aug. 14, 2020 (DK) ..... PA 2020 70534
Aug. 14, 2020 (DK) ..... PA 2020 70535

(51) Int. Cl.
*B65B 43/12* (2006.01)
*B65B 43/26* (2006.01)
(Continued)

(52) U.S. Cl.
CPC ..... *B65B 43/123* (2013.01); *B65B 43/267* (2013.01); *B65D 33/002* (2013.01); *B65D 75/44* (2013.01)

(58) Field of Classification Search
CPC .... B65D 75/44; B65D 33/002; B65B 43/123; B65B 43/267
See application file for complete search history.

(56) References Cited

U.S. PATENT DOCUMENTS 3,199,671 A * 8/1965 Davy ..... B65D 75/42 206/390
3,559,874 A 2/1971 Titchenal
3,699,746 A 10/1972 Titchenal et al.
(Continued)

FOREIGN PATENT DOCUMENTS

EP 0 266 438 A1 5/1988
EP 1 087 890 B1 7/2004
(Continued)

OTHER PUBLICATIONS

International Search Report for PCT/DK2021/050259 mailed Nov. 18, 2021.
(Continued)

*Primary Examiner* — Andrew M Tecco
*Assistant Examiner* — Nicholas E Igbokwe
(74) *Attorney, Agent, or Firm* — Schmeiser, Olsen & Watts, LLP

(57) ABSTRACT

A web of bags configured to be guided through a filling station is provided. The web of bags may include a continuous guide of a guide material configured to be guided through the filling station. The guide may be connected with one or more bags of a bag material and with a bag opening. Also provided are methods of filling such bags on a web of bags and use of such web of bags.

13 Claims, 15 Drawing Sheets

(51) Int. Cl.
*B65D 33/00* (2006.01)
*B65D 75/44* (2006.01)

(56) References Cited

U.S. PATENT DOCUMENTS

| | | | | |
|---|---|---|---|---|
| 3,791,573 | A | 2/1974 | Titchenal et al. | |
| 4,045,713 | A | 8/1977 | Goto | |
| 4,569,083 | A | 2/1986 | Titchenal | |
| 4,630,311 | A * | 12/1986 | Bentson | B65D 33/002 206/820 |
| 4,945,713 | A | 8/1990 | Widenback | |
| 6,591,586 | B1 * | 7/2003 | Pape | B65B 43/123 53/457 |
| 6,598,374 | B1 * | 7/2003 | Ensor | B65B 39/12 141/114 |
| 2002/0147090 | A1 * | 10/2002 | Kuge | B65D 31/10 493/162 |
| 2005/0121099 | A1 * | 6/2005 | Hansen | B65B 9/087 141/10 |
| 2010/0266223 | A1 * | 10/2010 | Lin | B65D 31/02 383/114 |
| 2012/0093443 | A1 * | 4/2012 | Klein | B65D 31/00 383/211 |
| 2017/0137155 | A1 * | 5/2017 | Pape | B65B 1/04 |

FOREIGN PATENT DOCUMENTS

| | | | |
|---|---|---|---|
| EP | 2492207 | A1 | 8/2012 |
| EP | 3160862 | A1 | 5/2017 |
| EP | 3160863 | A1 | 5/2017 |
| EP | 3277595 | A1 | 2/2018 |
| EP | 3307641 | A1 | 4/2018 |
| FR | 2746369 | A1 | 9/1997 |
| GB | 1195959 | A | 6/1970 |
| JP | S4723315 | U | 11/1972 |
| JP | S49137959 | U | 11/1974 |
| JP | S56164940 | U | 12/1981 |
| WO | 9957017 | A1 | 11/1999 |
| WO | 03008272 | A1 | 1/2003 |
| WO | 2007139465 | A1 | 12/2007 |
| WO | 2007139466 | A1 | 12/2007 |
| WO | 2012/115672 | A1 | 8/2012 |
| WO | 2016/000717 | A1 | 1/2016 |
| WO | 2016/000718 | A1 | 1/2016 |
| WO | 2016/155748 | A1 | 10/2016 |
| WO | 2016/202342 | A1 | 12/2016 |
| WO | 2020108719 | A1 | 6/2020 |

OTHER PUBLICATIONS

Written Opinion for PCT/DK2021/050259 mailed Nov. 18, 2021.
"Agency for Finnish bag manufacturer", Magazine: Packmarknaden (Nov. 2008). (Partial English Translation).
Pronova Packaging Systems, Pronova ABs news page, Webarchive Aug. 18, 2010, The Wayback Machine -https://web.archive.org/web/20100818203208/http://www.pronovaab.se/nyheter.htm (Partial English Translation).

* cited by examiner

Fig. 3A
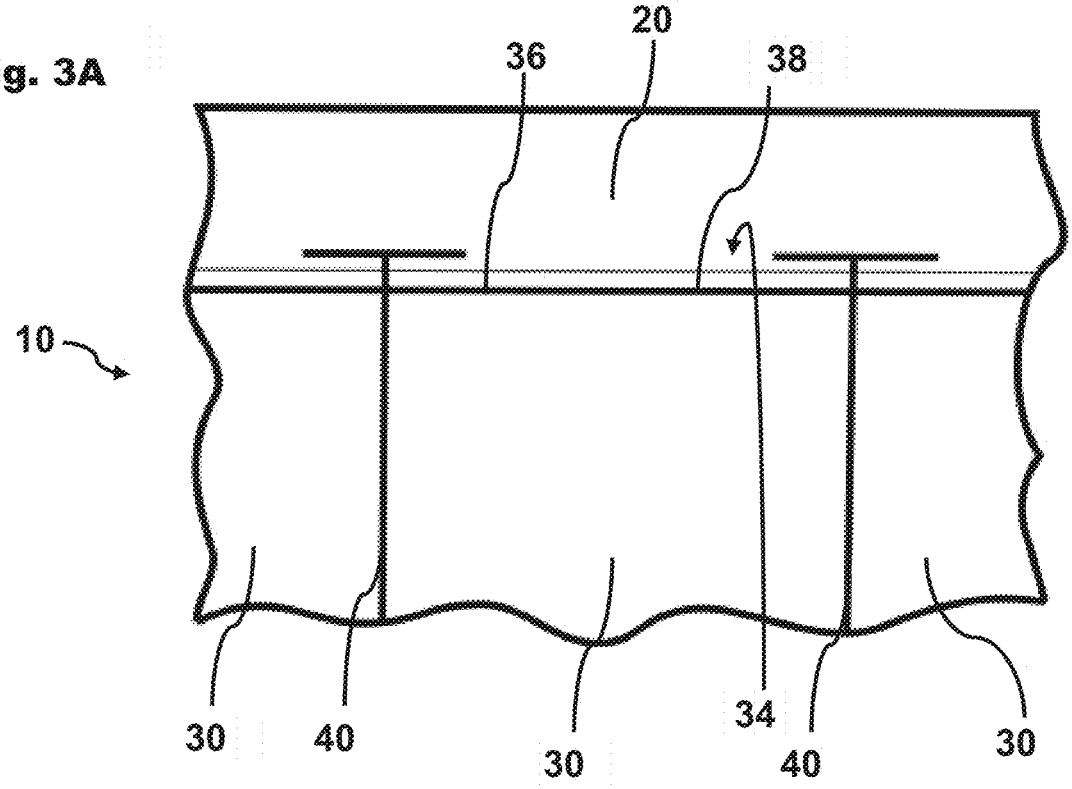
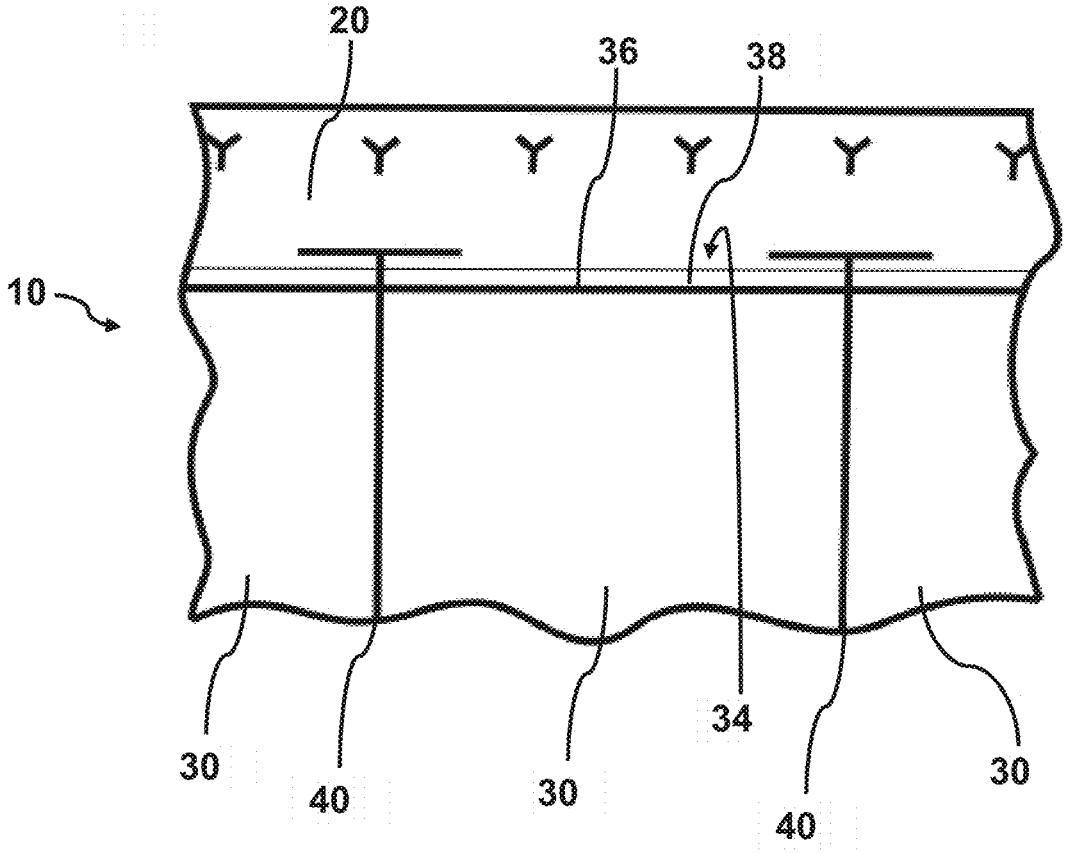
Fig. 3B

Fig. 6A
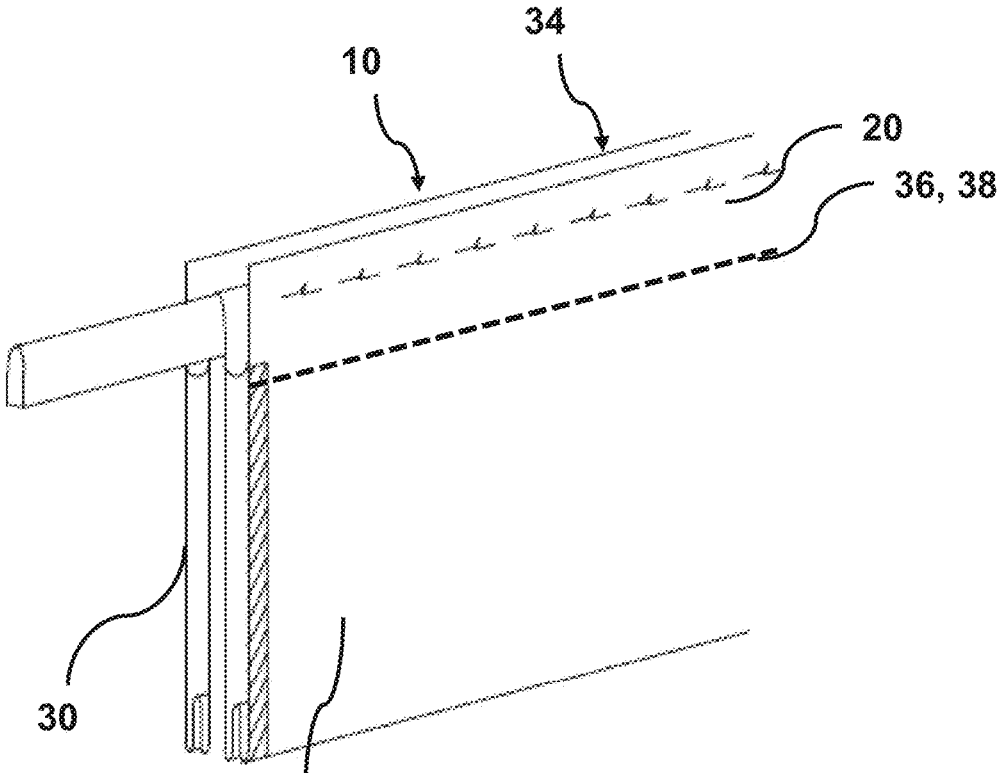
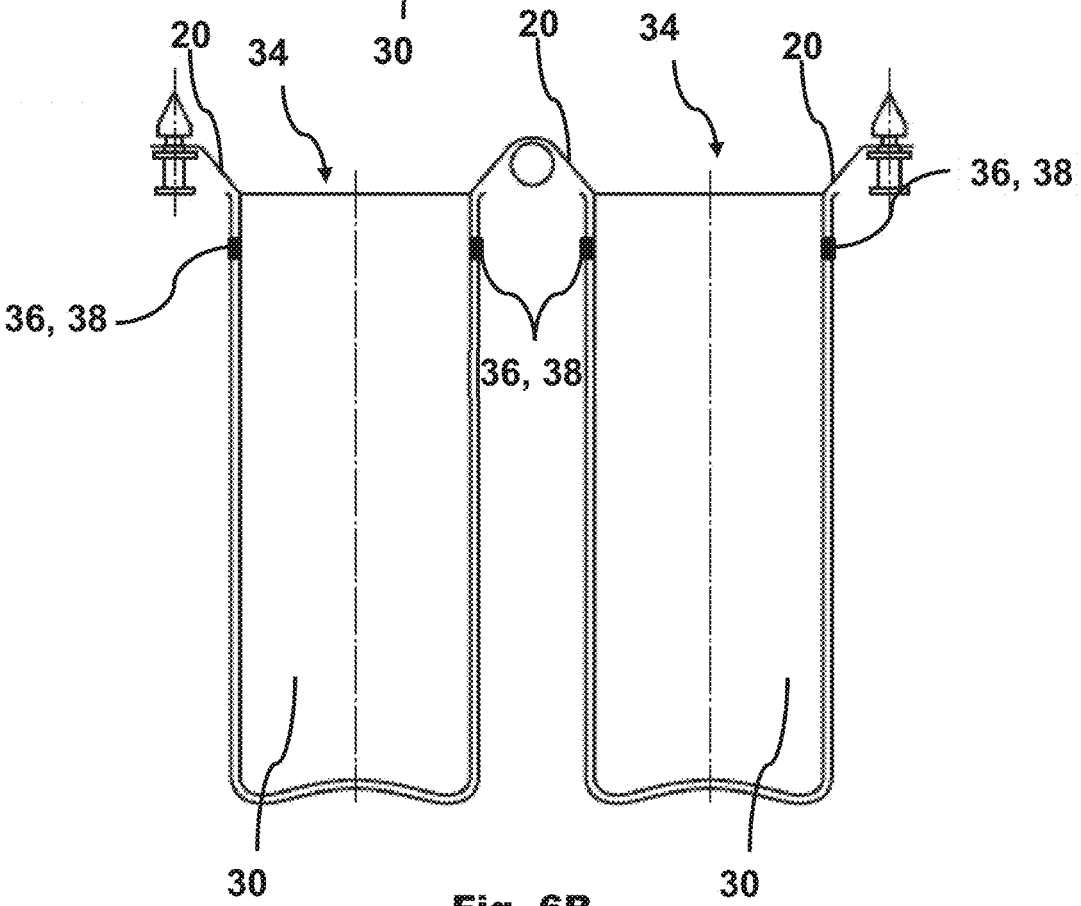
Fig. 6B

Fig. 8A
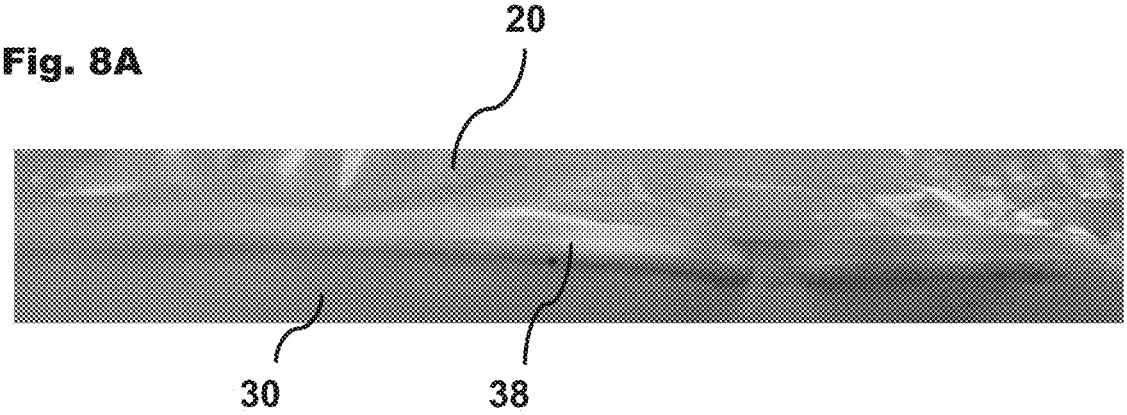
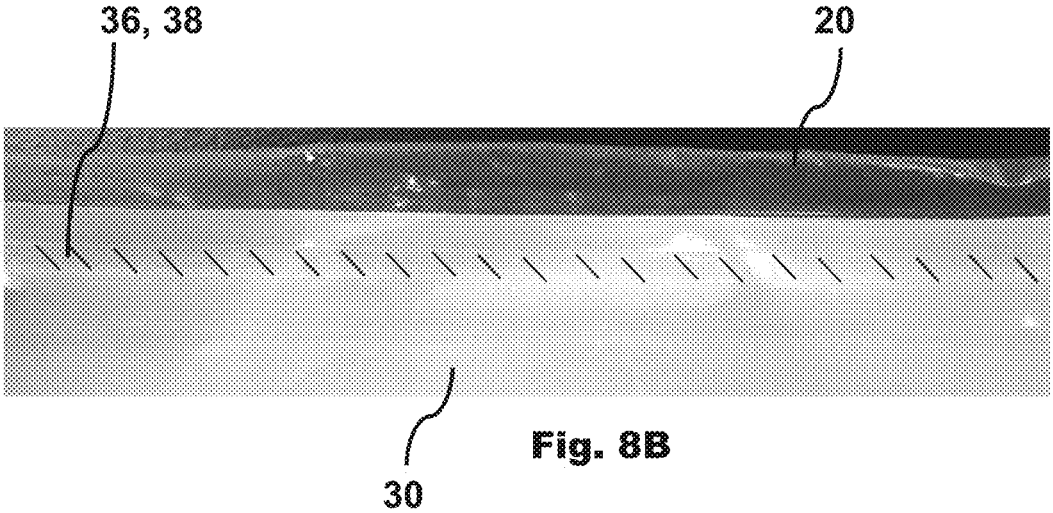
Fig. 8B
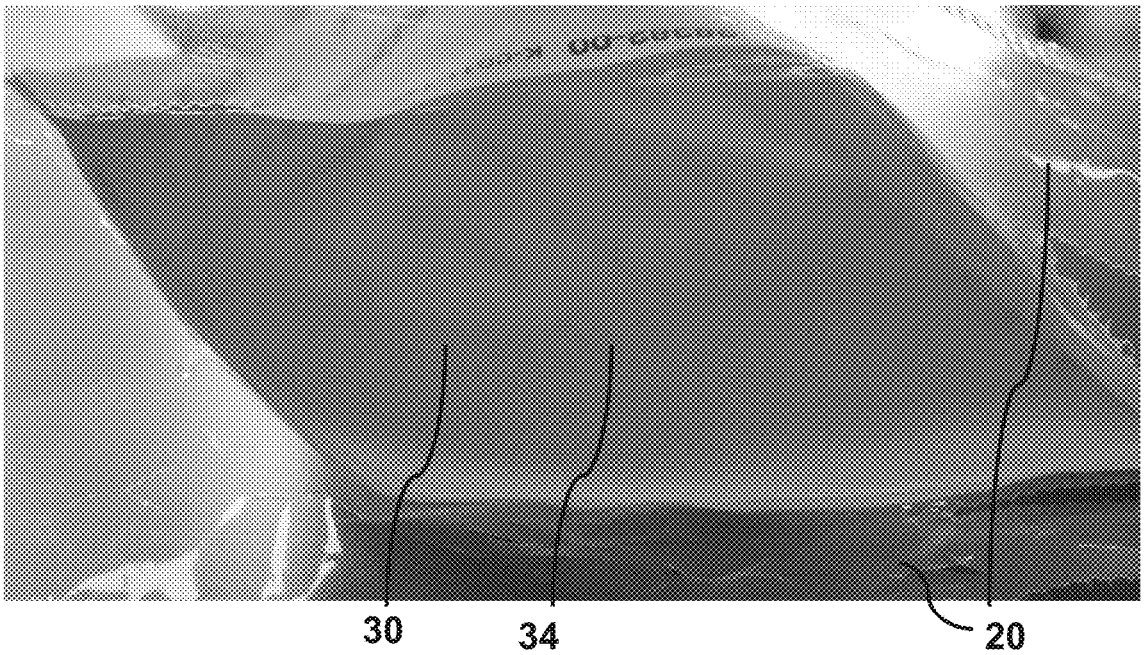
Fig. 8C

Fig. 12A
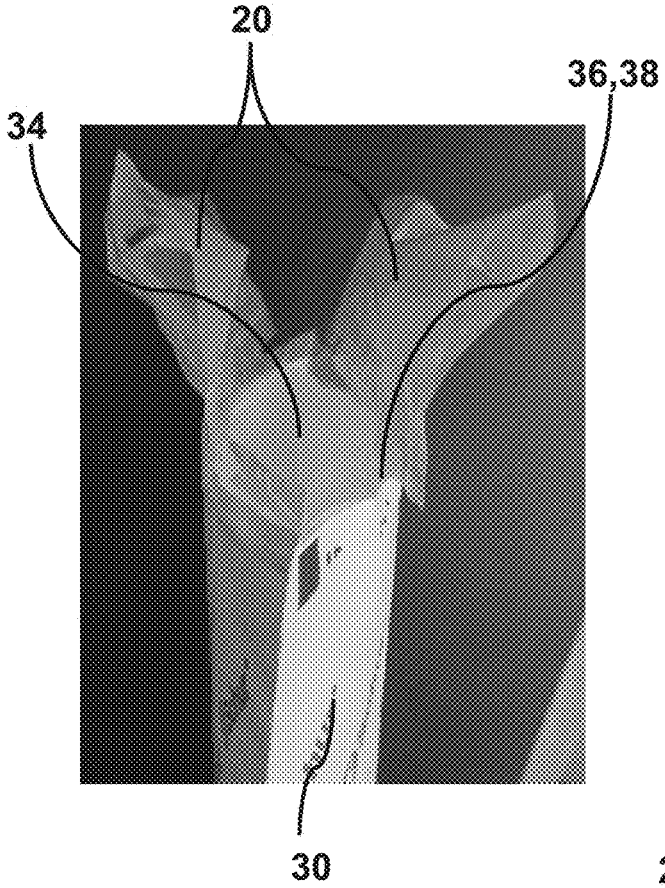
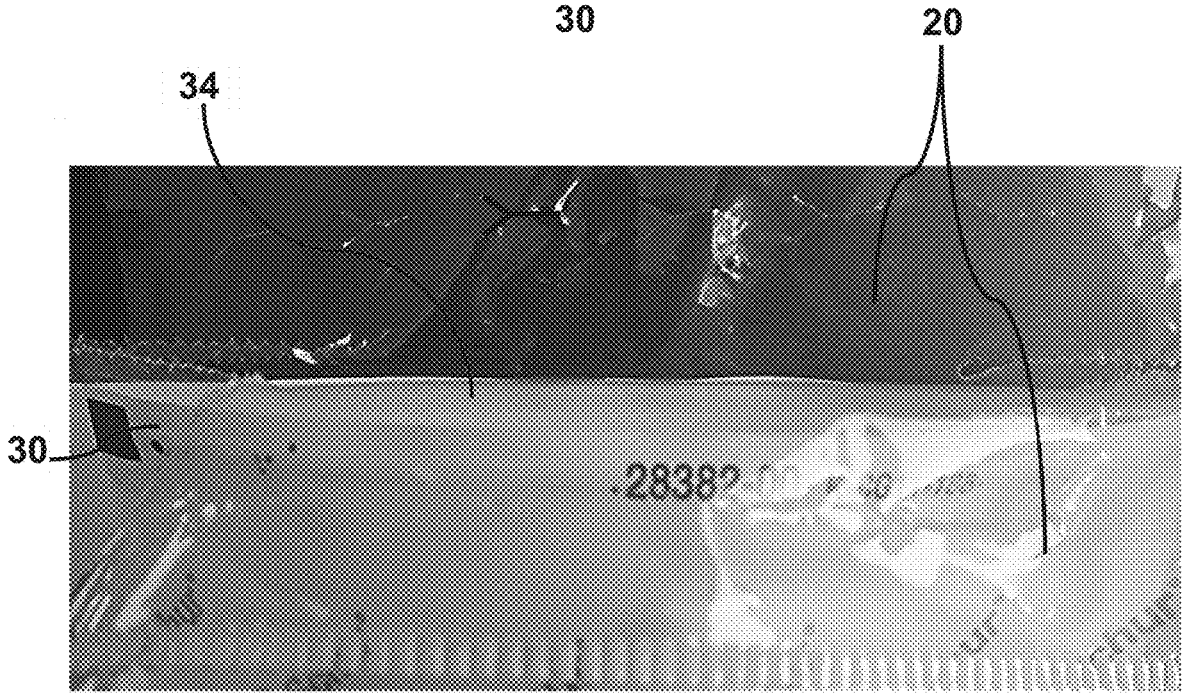
Fig. 12B

WEB OF BAGS WITH GUIDE AND BAGS OF DIFFERENT MATERIALS

CROSS-REFERENCE TO RELATED APPLICATIONS

This application claims priority to PCT Application No. PCT/DK2021/050259, having a filing date of Aug. 13, 2021, which is based DK Application No. PA 2020 70534, having a filing date of Aug. 14, 2020 and DK Application No. PA 2020 70535, having a filing date of Aug. 14, 2020 and DK Application No. BA 2020 00077, having a filing date of Aug. 14, 2020, the entire contents all of which are hereby incorporated by reference.

FIELD OF TECHNOLOGY

The following relates to a web of bags configured to be guided through a filling station. The web of bags may comprise a continuous guide of a guide material configured to be guided through the filling station. The guide may be connected with one or more bags of a bag material and with a bag opening. The following also relates to methods of filling such bags on a web of bags and use of such web of bags.

BACKGROUND

Effective filling of bags with content or articles on an industrial scale is an important technical area. Filling stations have been developed over many years and have been configured to operate effectively.

Filling stations may be those disclosed in EP1087890 or EP3160862 or EP3160863 or EP3307641 or EP3277595 or WO2020108719 and known as Schur® Star or Schur® StarLight. Other similar filling stations or alternative filling stations may be used. Bags often serve a purpose beyond keeping the content or articles in portions for delivery. Bags may provide protection to the content or articles and improve or even enable delivery and presentation of their content. A barrier on the bag may be required.

Such filling stations and webs of bags have been co-developed and mutually adopted to work effectively.

Polymers have shown to provide both effective handling and operation as a guide and operational interface with a filling station. Polymers or the likes have shown to be very suitable as guides on a web bag since they are flexible i.e., durable and tear resistant.

Therefore webs or webs of bags are effectively produced in the same material.

(a) However, bags of a material optimized and e.g., with automated or semi-automated processes have shown to pose a negative impact on the environment when disposed.

(b) Accordingly, there is a need to improve and provide alternatives to the conventional art of industrial filling of bags on an industrial scale.

(c) There is a need to provide a durable bag that can be disposed with low environmental impact.

(d) There is also a need to provide a bag that can be filled and i.e., withstand automated or semi-automated industrial processes to provide high quantities of environmentally sound bags.

At the same time there is a need to secure and maintain existing effective production systems, i.e., effective filling stations that are automated or semi-automated.

SUMMARY

An aspect relates to a web of bags configured to be guided through a filling station. The web of bags may comprise a continuous guide of a guide material configured to be guided through the filling station. The guide may be connected with one or more bags of a bag material and with a bag opening. The bag material is different from the guide material. The bag material may be less flexible than the guide material.

Thereby is achieved that existing configurations and compositions of guides can be maintained and used on existing filling stations whilst allowing that bag materials with a reduced environmental impact can be provided.

Hence, bags of environmentally more sound materials than guide materials can be filled in an optimized fashion in an automated or semi-automated process. Even on an industrial scale.

A further advantage is achieved by providing durability; that is a bag that is durable during the filling process and during use as a bag per se, and a bag that can be disposed with low environmental impact. That is that the bag can be filled, i.e., withstand an automated or semi-automated industrial process to provide high quantities of environmentally sound bags.

A further advantage is that highly effective filling systems and machinery can be used and maintained and thereby existing effective production systems, i.e., effective filling stations that are automated or semi-automated can be used.

The guide material may be a flexible i.e., stretchable material that is used in existing filling systems.

The bag material may be an environmentally sound material such as paper or aluminum.

In embodiments the bag material may be selected amongst fibrous materials such as paper or metallic foils such as aluminum foils.

In an embodiment, the bag material of the web of bags is paper. The paper used may vary according to the need. The paper may be coated with a protective barrier.

The paper may have a density of 30 to 150 g/m2 or even to 250 g/m2. The paper may be laminated or layered structure of a, in example, 25 g/m2 and a 50 g/m2.

The paper may be partially or fully coated paper. For fully coated paper, the coating may constitute 18-22 weight %.

The thickness may be in the order of 10-500 um, such as 50-200 um, or say about 100-120 um. The tensile stiffness (MD) may be in the order of 10 kNm/g.

The paper or fibrous material may be carton or cardboard types.

The bag material of the web of bags may also be aluminum or aluminum foils.

Such fibrous materials and metallic foils generally have lower flexibilities and are subject to tear during handling and in particular during industrial scale handling. Such materials however possess advantageous properties in respect of environmental soundness or protective properties.

In an embodiment, the guide material of the web of bags is polymer or plastic, such as a thermoplastic or thermoplastic polymer.

Guide materials may be a polymer such as polypropylene or polyethylene. A person skilled in the conventional art will appreciate the differences and be able to select configurations providing the flexibility and durability suitable for existing filling stations. Such polymers exist with different sealing and densities suitable for specific packaging or filling purposes. The polymers are sealable, temperature resistant and have suitable mechanical properties in respect of sufficient puncture resistance and flexibility balanced with rigidity.

In an embodiment, the guide material is a polymer and the bag material is a paper.

This particular combination of a polymer, such as polypropylene or polyethylene, and paper provides an effective production on an industrial scale of environmentally sound bags with content, which bags can be disposed or recycled.

In example, a bag of paper made of paper with a density of 60-70 g/m2 may be produced and with as little additives as possible such as less than 5 weight %.

In an embodiment, the web of bags may at least in one or more of the bags be attached to the guide by a splicing. The bag material may be prepared with a print defining a splicing path and the bag and the guide may be connected along at least part of the splicing path.

A splicing may be a way of connecting the guide and bag material. The splicing may be made by welding, including warm welding, or by gluing using glues or other gluing. Other ways may be by sewing.

In an embodiment, the print on the bag of the web of bags may be made by a lacquer or glue.

A person skilled in the conventional art may use polymer dispersion that is aqueous and acid-modified. Polyolefin dispersion may be used.

Such polymer dispersion may be designed or formulated according to specific uses of guide materials and bag materials For paper and polymer combinations such polyolefin dispersion may be mixed and serve as a starting point and base can be modified with rheology modifiers, waxes, etc. as required and thereby forming a resistant bonding upon proper treatment such as thermal curing.

A lacquer or varnish as well as glue with binding properties may be selected.

In an embodiment, the guide may be connected to one or more bags on the inside of one or more of the bags. The connection may be placed substantially along the bag opening of one or more of the bags of the web of bags.

It is understood that a bag has an inside and an outside. Attaching or connecting the guide material on the inside of the bag reduces the risk of tearing or destroying a bag or the bag web during the process of filling.

In an embodiment, the paper of the web of bags is pure paper comprising no more than a certain weight % of additives, such as less than or equal to 5 weight %, 20 weight % or 50 weight %.

By pure paper is understood a pure pulp part. The pulp may be so-called virgin pulp or recycled pulp.

The additives may be additives mixed into the paper or provided as a full or partial coating on one or more sides of the paper.

In an aspect there is a method of filling a bag with content. The method may comprise the act of providing a web of bags as a continuous guide of a guide material configured to be guided through the filling station. The guide may connect one or more bags of a bag material and with a bag opening. The bag material may be less flexible than the guide material. The bag material is of a different material than the guide material. There is an act of guiding the bags though a filling station in the guide. There is an act of filling content into one or more bags and there is an act of disconnecting one or more bags from the guide.

The method allows for effective industrial production of environmentally sound bags packed with content or articles.

There is an act of separating bags from the guide to produce individual consumer bags with content or articles. The bag may be cut of or otherwise separated. The cut may be in part of the bag material without any guide material. Alternatively part of the guide material may be left for later process.

There is an act of closing the bag. The bag may be closed by use of splicing, welding or gluing as disclosed previously.

Hence a bag of a different material than a guiding material effective or optimized for filling stations is effectively produced. Such bag may be of an environmental sound or disposable material contrary to the guide material.

In an embodiment in the method of filling a bag, the guide material may be a polymer and the bag material may be a paper. The guide material and the polymer material may be as previously disclosed.

This particular combination of a polymer, such as polypropylene or polyethylene, and paper provides an effective production on an industrial scale of environmentally sound bags with content, which bags can be disposed or recycled.

In example, a bag of paper made of paper with a density of 60-70 g/m2 may be produced and possibly with as little additives as possible such as less than 5 weight %.

In an aspect there is a bag product with content produced by a process of providing a web of bags as a continuous guide of a guide material configured to be guided through the filling station. The guide may be connected with one or more bags of a bag material and with a bag opening. The bag material may be less flexible than the guide material. The bag material is different from the guide material. The bag may be attached to the guide by way of a splicing defining a splicing path. The bag and the guide may be connected along at least part of the splicing path guiding the web of bags though a filling station in the guide, filling content into one or more bags and disconnecting one or more bags from the guide leaving at least part of the guide material along the slicing path on the paper bag. The bag and the guide may then be closing the bag by splicing the left guide material on the paper bag.

Hence an end product bag, or consumer product bag, of a specific material such as an environmentally sound material may be provided.

As outlined the bag has significantly less guiding material left, which guiding material may be included in the accounts of additives as outlined and a durable bag may be readily disposable.

In an embodiment, the bag material of the bag may be paper and the filling station is configured to guide a web of bags with a polymer guide.

In example a polymer may be used as guiding material and paper may be used as a bag material. Durable bag of paper with a density of 60-70 g/m2, or as previously outlined, may be produced. The weight % of additives may be controlled by simple and result in a bag that can be disposed within environmental requirements. The bag being paper is pure paper comprising no more than a certain weight % of additives, such as less than or equal to 5 weight %, 20 weight % or 50 weight %.

In an aspect there is a bag product with content produced by a process of providing a web of bags as a continuous guide of a guide material configured to be guided through the filling station. The guide may be connected with one or more bags of a bag material and with a bag opening. The bag material may be less flexible than the guide material. The bag material is different from the guide material. The bag material may be paper which is 30-150 g/m2, e.g., 60-70 g and the paper may be pure paper comprising only a certain weight % of additives, such as less than or equal to 5 weight %, 20 weight % or 50 weight %, guiding the web of bags though a filling station in the guide, filling content into one or more bags, disconnecting the one or more bags from the guide leaving at least part of the guide material along the slicing path on the paper bag and closing the bag.

Hence an end product bag, or consumer product bag, of a specific material such as paper being an environmentally sound material may be provided.

As outlined the bag has no guiding material left a durable bag may be readily disposable.

In example a polymer may be used as guiding material and paper may be used as a bag material. Durable bag of paper with a density of 60-70 g/m2 may be produced.

The weight % of additives may be controlled by simple and result in a bag that can be disposed within environmental requirements.

Thereby delivering a paper bag with content or articles, where the paper bag after usage can be disposed.

The bag being paper is pure paper comprising no more than a certain weight % of additives, such as less than or equal to 5 weight %, 20 weight % or 50 weight %.

Ultimately a disposable paper bag with a weight % of less than 5 weight % may be produced on an industrial scale.

In an aspect there is a use of a web of bags in a filling station configured to guide a web of bags with a guide of a flexible material and to fill bags. The bag material is different from the guide material. The web of bags may comprise bags of a bag material less flexible than the guide material. The web of bags may be as described herein.

Existing filling stations as exemplified and disclosed in the mentioned patent documents and similar devices may be constructed or used without or with few adjustments thereby reusing existing industrial capacity to effectively produce environmentally friendly packaging or bags.

Other existing filling stations suitable for a flexible guide as disclosed may be constructed or used as well.

In another embodiment of the invention there is a web of bags configured to be guided through a filling station, wherein the web of bags comprises a continuous guide of a guide material configured to be guided through the filling station. The guide is connected with one or more bags of a bag material and with a bag opening.

The bag material comprises the same material as the guide material. The bag material and guide material are selected amongst fibrous materials such as paper.

The bag material may be less flexible than the guide material.

Thereby is achieved that existing configurations and geometries of guides can be maintained and used on existing filling stations whilst allowing that bag materials with a reduced environmental impact can be provided.

Hence, bags and guides of environmentally more sound materials can be filled in an optimized fashion in an automated or semi-automated process. Even on an industrial scale.

A further advantage is achieved by providing durability; that is a bag that is durable during the filling process and during use as a bag per se, and a bag that can be disposed with low environmental impact. That is that the bag can be filled, i.e., withstand an automated or semi-automated industrial process to provide high quantities of environmentally sound bags.

Furthermore the guide material shares the same advantageous characteristics after use as mentioned for the bag.

A further advantage is that highly effective filling systems and machinery can be used and maintained and thereby existing effective production systems, i.e., effective filling stations that are automated or semi-automated can be used.

The guide material may be a more flexible material than the bag material.

In an embodiment the web of bags is formed from a single piece of fibrous material, e.g., a sheet or a roll.

In an embodiment the guide material is a first fibrous material such as a first paper material and the bag material is a second fibrous material such as a second paper material.

Thus the materials may be disposable and environmentally friendly to the same extend. The guide may be recycled or disposed. The bags may be of different properties the first and second materials may be distinct and separated.

The guide material may be a first type of fibrous material such as a first paper material. The guide material can be selected as disclosed below. The guide material may comprise additives to increase the flexibility and stretchability of the guide.

In example, a guide of paper made of paper with a density of 60-70 g/m2 or less. In example the guide may be produced with as little additives as possible such as less than 50 weight %, 20 weight %, and 5 weight %.

In an embodiment, the bag material of the web of bags is paper. The paper used may vary according to the need. The paper may be coated with a protective barrier.

The paper may have a density of 30 to 150 g/m2 or even to 250 g/m2. The paper may be laminated or layered structure of a, in example, 25 g/m2 and a 50 g/m2.

The paper may be partially or fully coated paper. For fully coated paper, the coating may constitute 18-22 weight %.

The thickness may be in the order of 10-500 um, such as 50-200 um, or say about 100-120 um. The tensile stiffness (MD) may be in the order of 10 kNm/g.

In an embodiment, the web of bags may at least in one or more of the bags be attached to the guide by a splicing. The bag material may be prepared with a print defining a splicing path and the bag and the guide may be connected along at least part of the splicing path.

A splicing may be a way of connecting the guide and bag material. The splicing may be made by welding, including warm welding, or by gluing using glues or other gluing. Other ways may be by sewing.

In an embodiment, the print on the bag of the web of bags may be made by a lacquer or glue.

A person skilled in the conventional art may use polymer dispersion that is aqueous and acid-modified. Polyolefin dispersion may be used.

Such polymer dispersion may be designed or formulated according to specific uses of guide materials and bag materials For paper and polymer combinations such polyolefin dispersion may be mixed and serve as a starting point and base can be modified with rheology modifiers, waxes, etc. as required and thereby forming a resistant bonding upon proper treatment such as thermal curing.

A lacquer or varnish as well as a glue with binding properties may be selected.

In an embodiment, the guide may be connected to one or more bags on the inside of one or more of the bags. The connection may be placed substantially along the bag opening of one or more of the bags of the web of bags.

It is understood that a bag has an inside and an outside. Attaching or connecting the guide material on the inside of the bag reduces the risk of tearing or destroying a bag or the bag web during the process of filling.

In an embodiment, the paper of the web of bags is pure paper mixed with no more than a certain weight % of additives, such as less than or equal to 5 weight %, 20 weight % or 50 weight %.

By pure paper is understood a pure pulp part. The pulp may be so-called virgin pulp or recycled pulp.

The additives may be additives mixed into the paper or provided as a full or partial coating on one or more sides of the paper.

In another embodiment, there is a method of filling a bag with content, the method comprising acts as follows.

There is an act of providing a web of bags as a continuous guide of a guide material configured to be guided through the filling station and wherein the guide has connected one or more bags of a bag material and with a bag opening, wherein the bag material comprises the same material as the guide material and wherein the guide material and bag material is selected amongst fibrous materials such as paper.

There is an act of guiding the web of bags though a filling station in the guide.

There is an act of filling content into one or more bags.

There is an act of disconnecting the one or more bags from the guide.

The method allows for effective industrial production of environmentally sound bags packed with content or articles. The method also allows for environmentally sound guide material.

There is an act of separating bags from the guide to produce individual consumer bags with content or articles. The bag may be cut of or otherwise separated. The cut may be in part of the bag material without any guide material. Alternatively part of the guide material may be left.

In an aspect there is a use of a web of bags in a filling station configured to guide a web of bags with a guide of a fibrous material such as paper and to fill bags, wherein the web of bags comprises bags of a bag material of a fibrous material such as paper.

The web of bags as disclosed may be used.

Alternatively to the above described web bags with the same guide and bag materials there may be the following further aspects of a web of bags.

Embodiments of the present invention also concern alternative aspects as will be described in the following.

In an aspect there is a web of bags configured to be guided through a filling station.

In the context of embodiments of the present invention, unless indicated otherwise, "%" indicates % weight/weight (w/w).

In the context of embodiments of the present invention, the terms "about", "around", "approximately" or the symbol "~" can be used interchangeably and are meant to comprise variations generally accepted in the field, e.g., comprising analytical errors and the like. Thus "about" may also indicate measuring uncertainty commonly experienced in the conventional art, which can be in the order of magnitude of e.g., +/−1, 2, 5, 10, 20, or even 50 percent.

The term "comprising" is to be interpreted as specifying the presence of the stated parts, steps, acts, features, or components, but does not exclude the presence of one or more additional parts, steps, features, or components. For example, a composition comprising a chemical compound may thus comprise additional chemical compounds.

BRIEF DESCRIPTION

Some of the embodiments will be described in detail, with references to the following Figures, wherein like designations denote like members, wherein:

FIG. 3A illustrates a web of bags without and with perforations;

FIG. 3B illustrates a web of bags without and without perforations;

FIG. 6A illustrates a web of bags comprising dual bags;

FIG. 6B illustrates a web of bags with print;

FIG. 8A illustrates the splicing path from an outside view

FIG. 8B illustrates an inside view of a bag;

FIG. 8C illustrates a top view of an open bag;

FIG. 12A illustrates an embodiment of guides;

FIG. 12B illustrates another embodiment of a guide

| Item | Reference |
|---|---|
| web of bags | 10 |
| guide | 20 |
| guide material | 22 |
| Splice | 24 |
| bag | 30 |
| bag material | 32 |
| bag opening | 34 |
| print | 36 |
| splicing path | 38 |
| Post-filling splicing path | 39 |
| Separation line | 40 |
| cut path | 42 |
| Filling station | 80 |
| method of filling a bag | 100 |
| providing | 200 |
| guiding | 300 |
| filling | 400 |
| disconnecting | 500 |
| closing | 600 |

DETAILED DESCRIPTION

Figure 1:
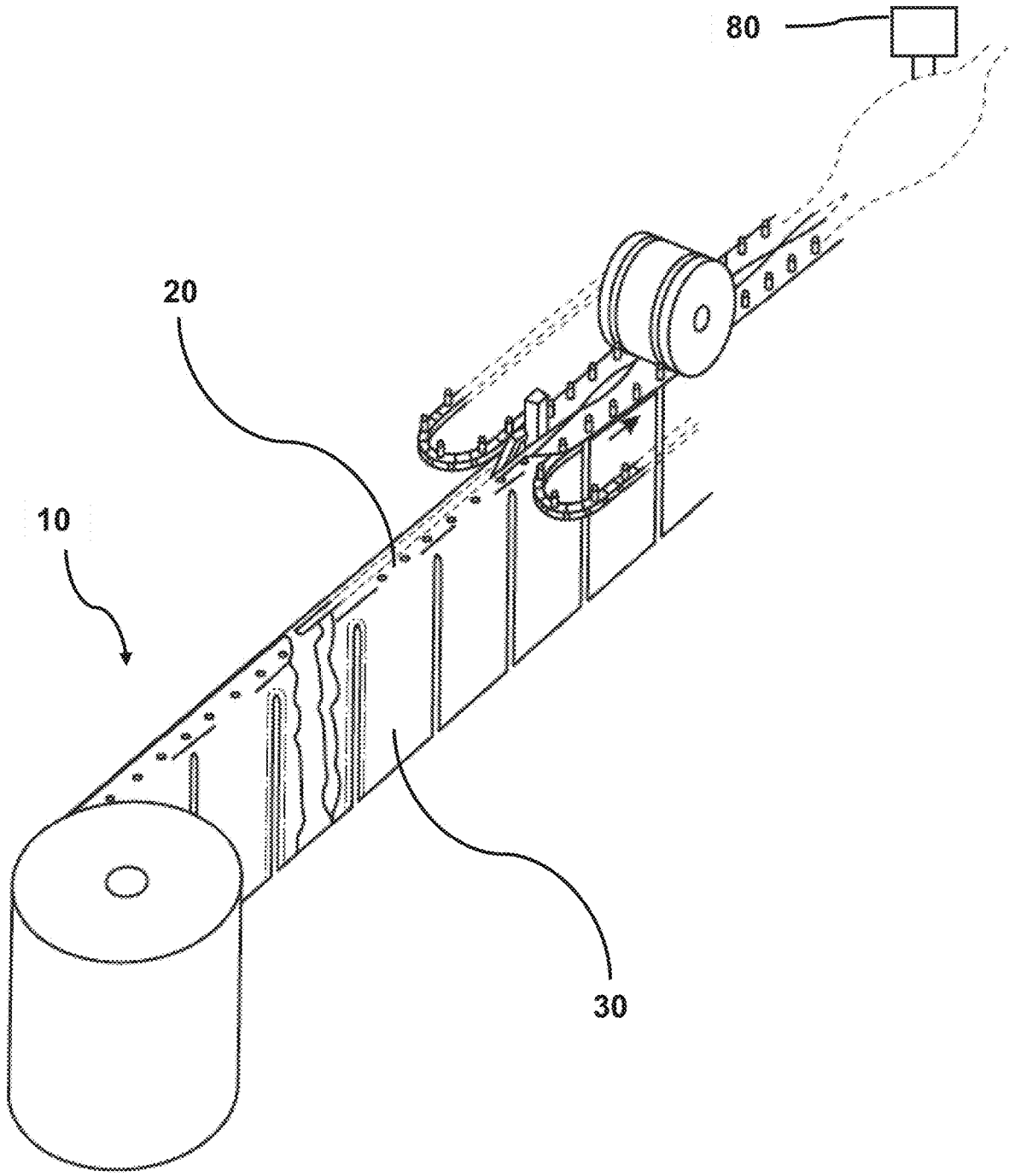
FIG. 1 illustrates a known system with a filling station for filling a web of bags.

FIG. 1 illustrates a known system with a filling station 80 for filling a web of bags 10.

The filling station 80 may be a manual filling station 80 or a semi-automatic filling station 80 or an automatic filling station 80.

The system is designed to fill bags 30 from a roll of web of bags, wherein the web of bags is made from a plastic material. The skilled person would know which plastic materials are used. The used plastic materials' characteristics are well known and the systems with filling stations are designed to work with these plastic materials. There is however a growing need for systems and webs of bags for filling paper bags.

The problem is that the present systems are designed for polymer or plastic materials and the characteristics of paper differ significantly from the used plastics or polymers. Paper's tear resistance is lower than the presently used plastics. Furthermore, paper cannot undergo the same elastic or plastic deformation as the polymer or plastics.

The skilled person would know that presently polypropylene (PP) and polyethylene (PE) are used as material in web of bags.

If a plastic web of bags 10 is replaced with a paper web of bags 30, the system would tear or damage too high a number of the bags for it to be viable. Thus, a new system must be designed taking into account the characteristics of paper, i.e., the limitations of paper relative to the presently used plastics.

The above-mentioned problems are the same, when trying to use aluminum as the system is not designed to handle aluminum.

Figure 2:
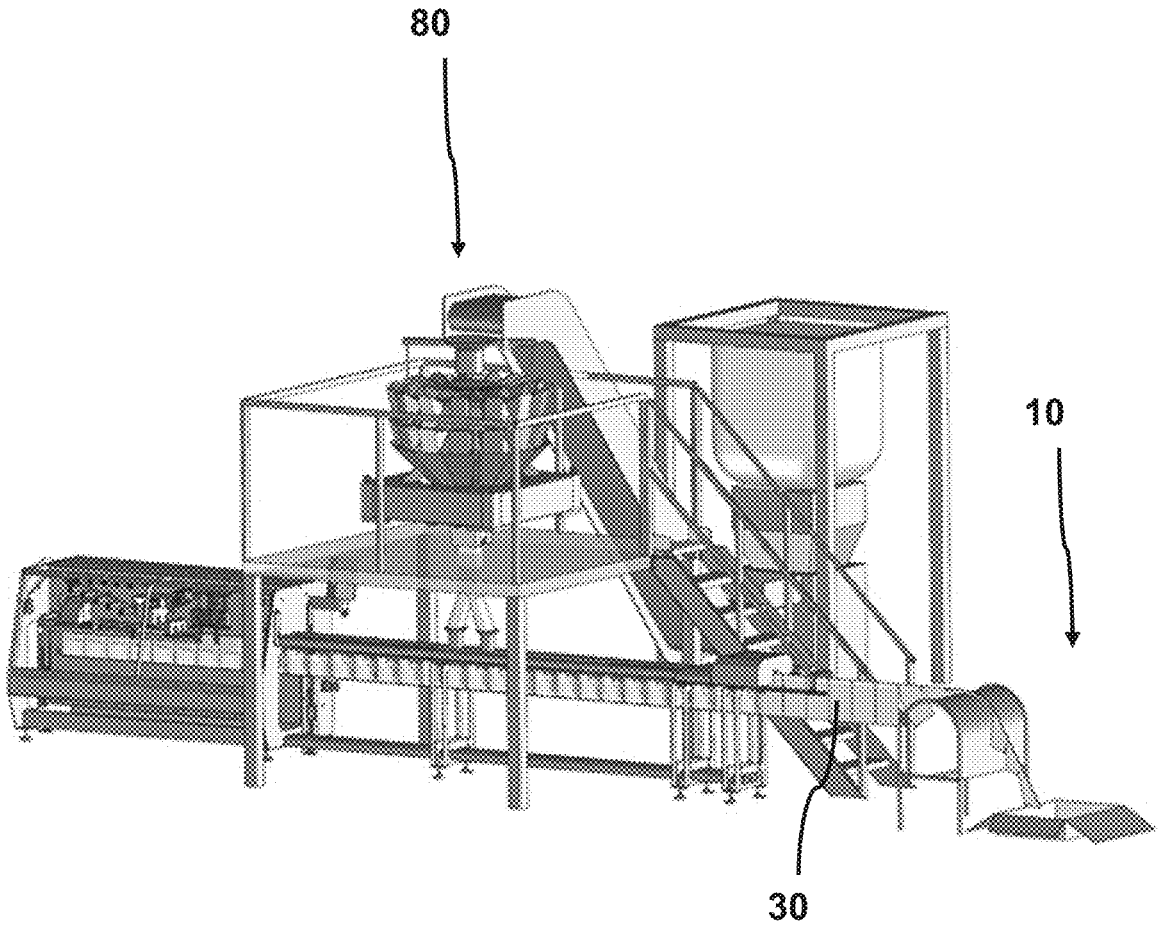
FIG. 2 illustrates a known system with a full-automatic filling station for filling a web of bags.

FIG. 2 illustrates a known system with a full-automatic filling station 80 for filling a web of bags 10. The web of bags 10 is fed to the system from a box.

The system is designed to be used with a web of bags 10 made of plastic or polymers such as polypropylene (PP) or polyethylene (PE).

However, it would be desirable if the system could be used to fill paper bags 30 or aluminum bags 30 or any other kind of material having different mechanical characteristics than plastic.

FIG. 3A illustrates a web of bags 30 without (3A) and FIG. 3B illustrates with perforations (3B).

The disclosed web of bags 30 can be used in filling systems as shown in FIGS. 1 and 2 even though the bag is made of a non-plastic material such as paper or aluminum. The resulting bag 30 filled with content will be a paper bag 30 filled on a system designed for plastic bags.

The disclosed web of bags 30 comprises a continuous guide 20 of a guide material configured to be guided through a filling station 80 such as but not limited to the filling system in FIGS. 1 and 2. The guide 22 is connected with one or more bags 30 made of a bag material. The one or more bags 30 have a bag opening 34 for receiving content.

The guide material may advantageously be known plastic or polymer materials presently used in a web of bags 30 such as polypropylene (PP) or polyethylene (PE), because the systems are designed with the plastic materials in mind.

In the present embodiment, the one or more bags 30 and the guide 20 are interconnected along a splicing path 38. The connection may be made by heat welding or pressure welding or by any other process capable of connecting the guide material with the bag material.

The individual bags 30 are separated by a separation line, thereby allowing individual movement of the bags. The separation line 40 has a T-shape in the guide 20 for allowing some movement.

The one or more bags may have a print 36 for enabling the connection between the guide 20 and the one or more bags 30. Thereby, the print 36 defines the splicing path 38. The print 38 may be a lacquer or glue. It will be necessary to add a print 36 if the one or more bags 30 are made of paper with equal to or less than 15 weight % of additives, or equal to or less than 10 weight % of additives, or equal to or less than 5 weight % of additives. The need for a print 36 increases as the amount of additives decreases because the strength of the splicing between the bag 30 and the guide 20 decreases as with the amount of additives; the print will compensate for the weakening of the splicing.

A bag material made of paper with a weight % of additives equal to or below 5% is desired because most of the EU has a limit for the amount of additives a recyclable paper may contain.

The guide 20 may comprise two plastics flaps on each side of the bag opening 34 for enabling the system to guide the bag of webs 10. The two plastics flaps may each be folded to form two channels for receiving guiding means. The guide 20 may have perforations as shown in FIG. 3B for insertions of studs. The guide 20 may have other means for enabling the guide through a system with a filling station.

Figure 4:
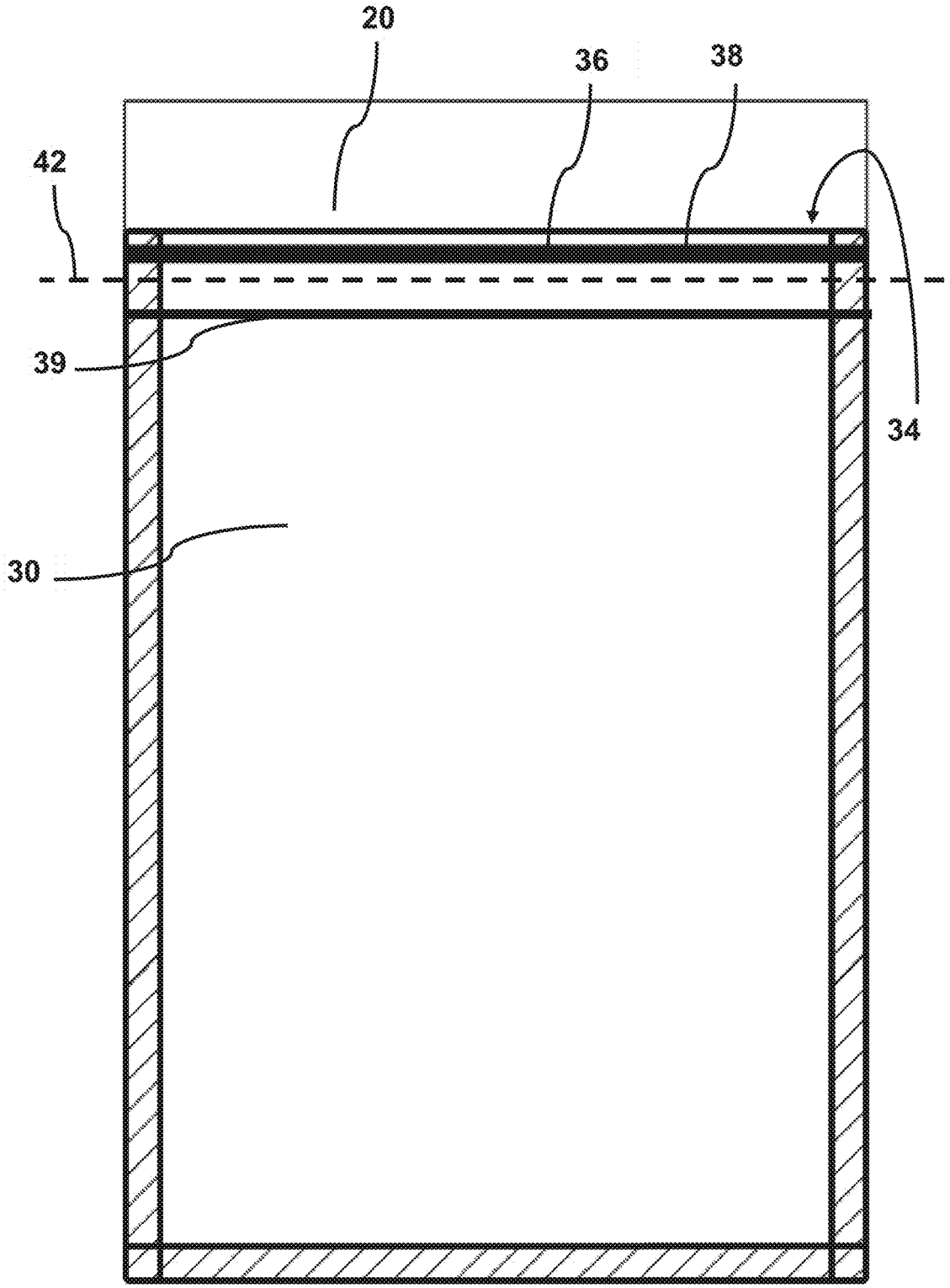
FIG. 4 illustrates a bag disconnected from a bag of webs.

FIG. 4 illustrates a bag 30 disconnected from a web of bags 10. The bag 30 will after it is filled with content be disconnected from web of bags 10.

However, the guide 20 is made of a guide material. The guide material may be a polymer or plastic such as polypropylene (PP) or polyethylene (PE). The guide material is unwanted and must be removed. The guide 20 is removed by cutting along a cut path 42 and the bag 30 is spliced along a post-filling splicing path 39 below the cut path 42 to prevent spillage from the now closed bag opening 34.

FIG. 4 illustrates the steps to be performed on the bag 30. The skilled person would know that the post-filling splicing may be done before disconnecting the bag 30 from the web of bags 10 and/or cutting along the cut path.

The resulting bag 30 can thus be made of a material which otherwise could not be used in present systems for filling webs of bags 10 as they are designed to filling webs of bags 30 made of a plastic material or the like.

Since the guide 20 is completely removed from the resulting bag 30, the purity of the resulting bag 30 is increased and thus it will be easier to recycle the bag 30.

Thereby, it is possible to produce the resulting bags 30 of paper sheets with a weight of 30-65 g/m2, while having additives being equal to or less than 5 weight %. This enables the bags 30 to be recyclable in at least the EU.

Figure 5:
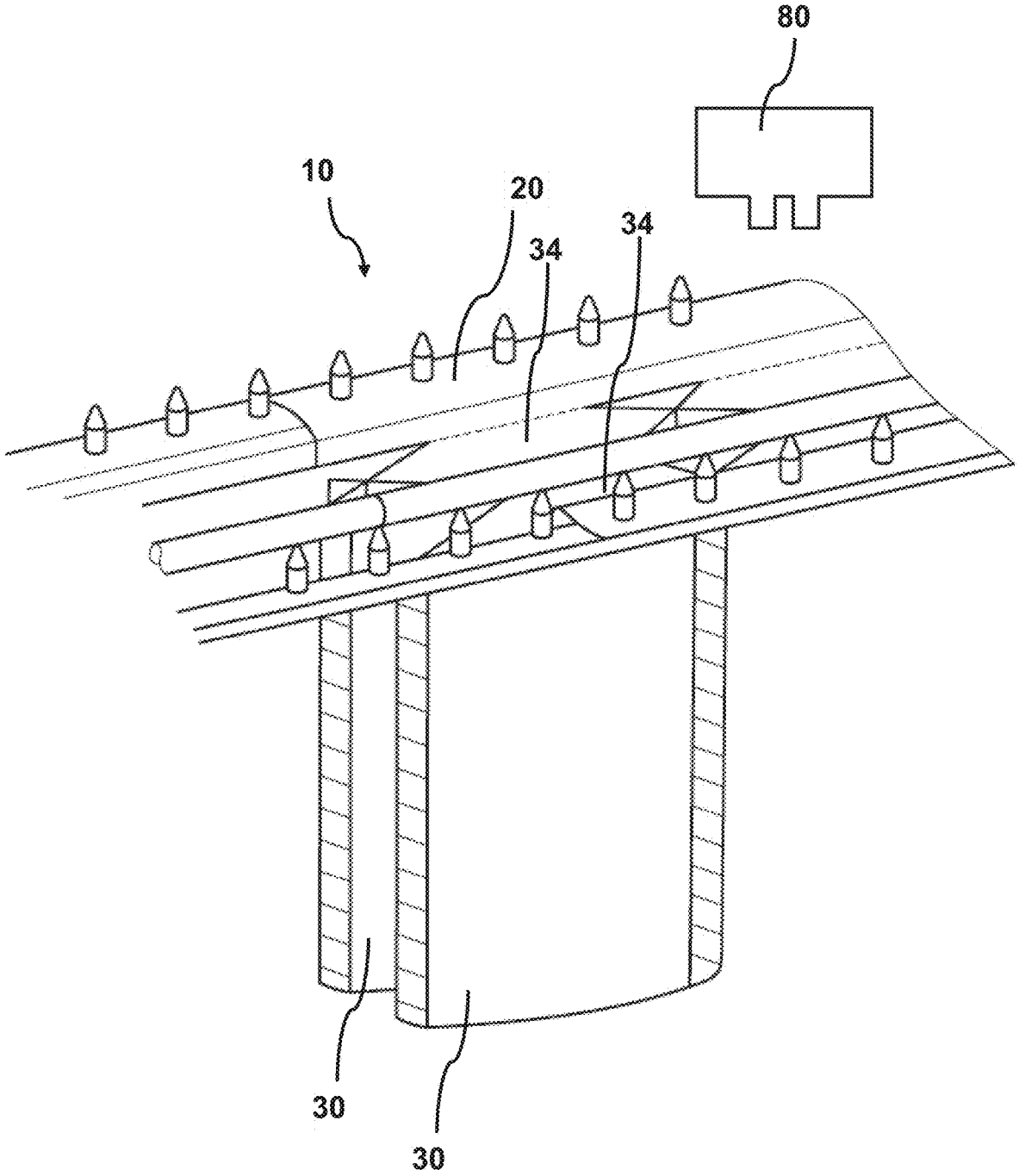
FIG. 5 illustrates a web of bags comprising dual bags moving through a filling station.

FIG. 5 illustrates a web of bags 10 comprising dual bags 30 moving through a filling station 80. The figure discloses an embodiment of a dual bag 30 from a web of bags 10 as shown in EP3160863.

The web of bags 10 can be modified in accordance with embodiments of the invention such that the bags 30 are made of a different material than plastic. This is shown in greater detail in FIG. 6A.

The web of bags 10 comprises a guide 20 connected to two bags 30. The connection is shown in FIG. 6A.

FIG. 6A illustrates a web of bags 10 comprising dual bags 30. The embodiment is identical to the embodiment disclosed in FIG. 5.

The web of bags 10 comprises a guide 20 made of a guide material, which will typically be a plastic or polymer material such as polypropylene (PP) or polyethylene (PE).

The guide 20 comprises a center part connected to both bags 30 and flaps with perforations connected to each bag 30 opposite to the center part.

The perforations are necessary for the shown guide system which comprises studs.

However, in other embodiments for other systems the flaps may form channels or just be flaps.

The web of bags has been modified by the bags 30 being a different material than the guide, wherein the guide 20 and bags 30 are connected along a splicing path 38 in order to connect the materials.

In some embodiments as shown in FIG. 6B, if the bag material is paper or aluminum it is necessary to print a print 36 on the inside of the bag 30 to ensure a sufficiently strong connection. In this case, the print 36 will define the splicing path 38.

Figure 7:
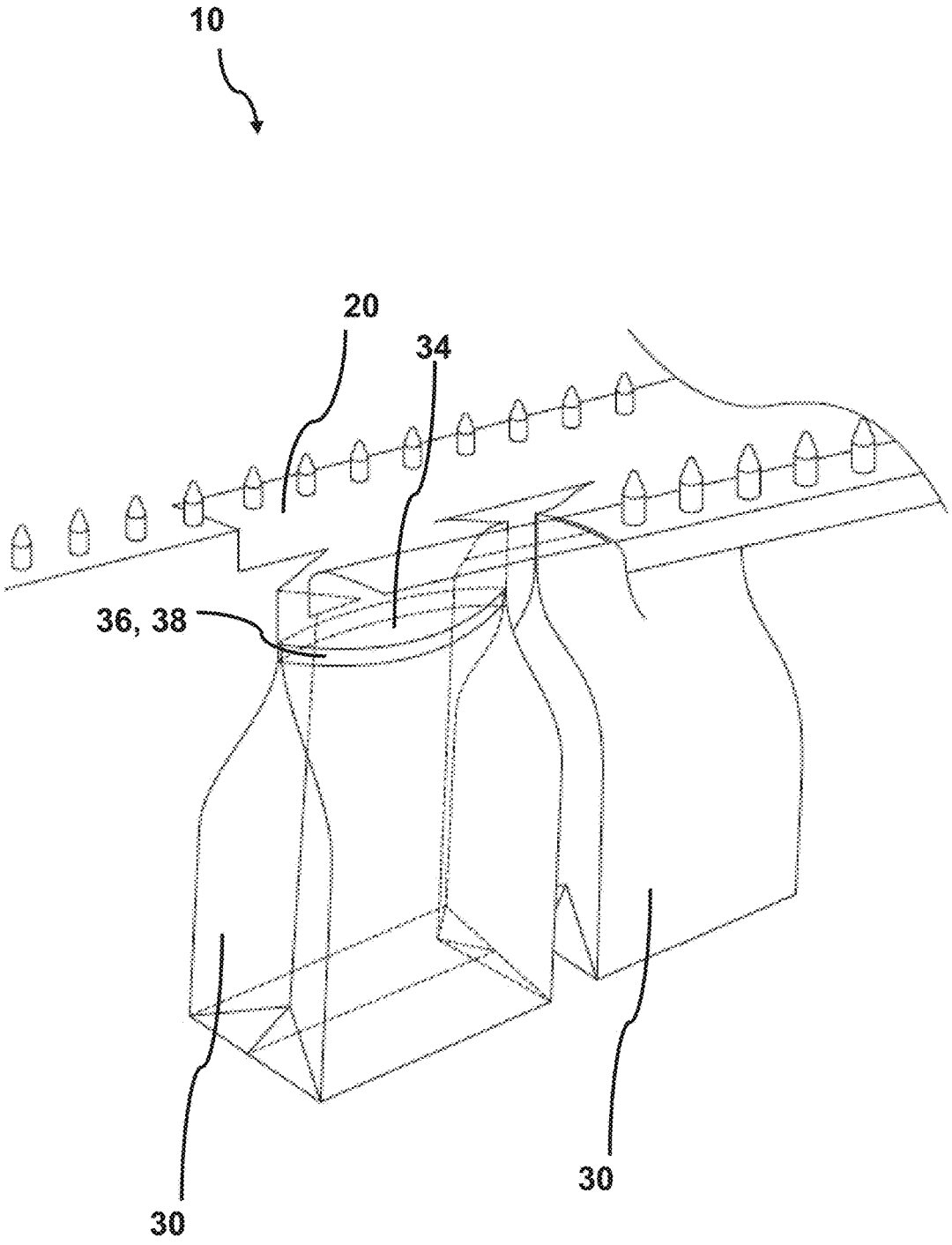
FIG. 7 illustrates another embodiment of the web of bags.

FIG. 7 illustrates another embodiment of a web of bags 10. The overall web of bags 10 design is known, however, previously the web of bags 10 was made of a single material.

The shown web of bags 10 comprises a guide 20 made of a guide material, which typically will be a plastic material.

The web of bags has been modified by the bags 30 being a different material than the guide, wherein the guide 20 and bags 30 are connected along a splicing path 38 in order to connect the materials.

In some embodiments, if the bag material is paper or aluminum it is necessary to print a print 36 on the inside of the bag 30 to ensure a sufficiently strong connection. In this case, the print 36 will define the splicing path 38.

FIG. 8 illustrates the splicing path 38 from an outside view (A) and an inside view (B) of a bag 30, and top view (C) of an open bag 30.

FIG. 8A discloses the connection between a guide 20 made of a polymer or plastic material, which may be polypropylene (PP) or polyethylene (PE), and a bag 30 made of a paper material from an outside view. The splicing path 38 is, in this embodiment, clearly shown as an indent. FIG. 8B discloses the connection between a guide 20 made of a plastic material and a bag 30 made of paper material from an inside view. The splicing path 38 is most visible on the left side of FIG. 8B.

The plastic or polymer material, i.e., guide 20 may be removed at a later stage by cutting along a cut path below the guide 20.

FIG. 8C illustrates a view into the bag 20 though the bag opening 34. The guide 20 is connected to the bag 30 on both sides of the bag opening 34.

The web of bags particular in this embodiment uses standard polymer as the guide and a paper bag made of 65 g/m2 paper with a thickness of about 100 um. The print is polyolefin dispersion.

Figure 9:
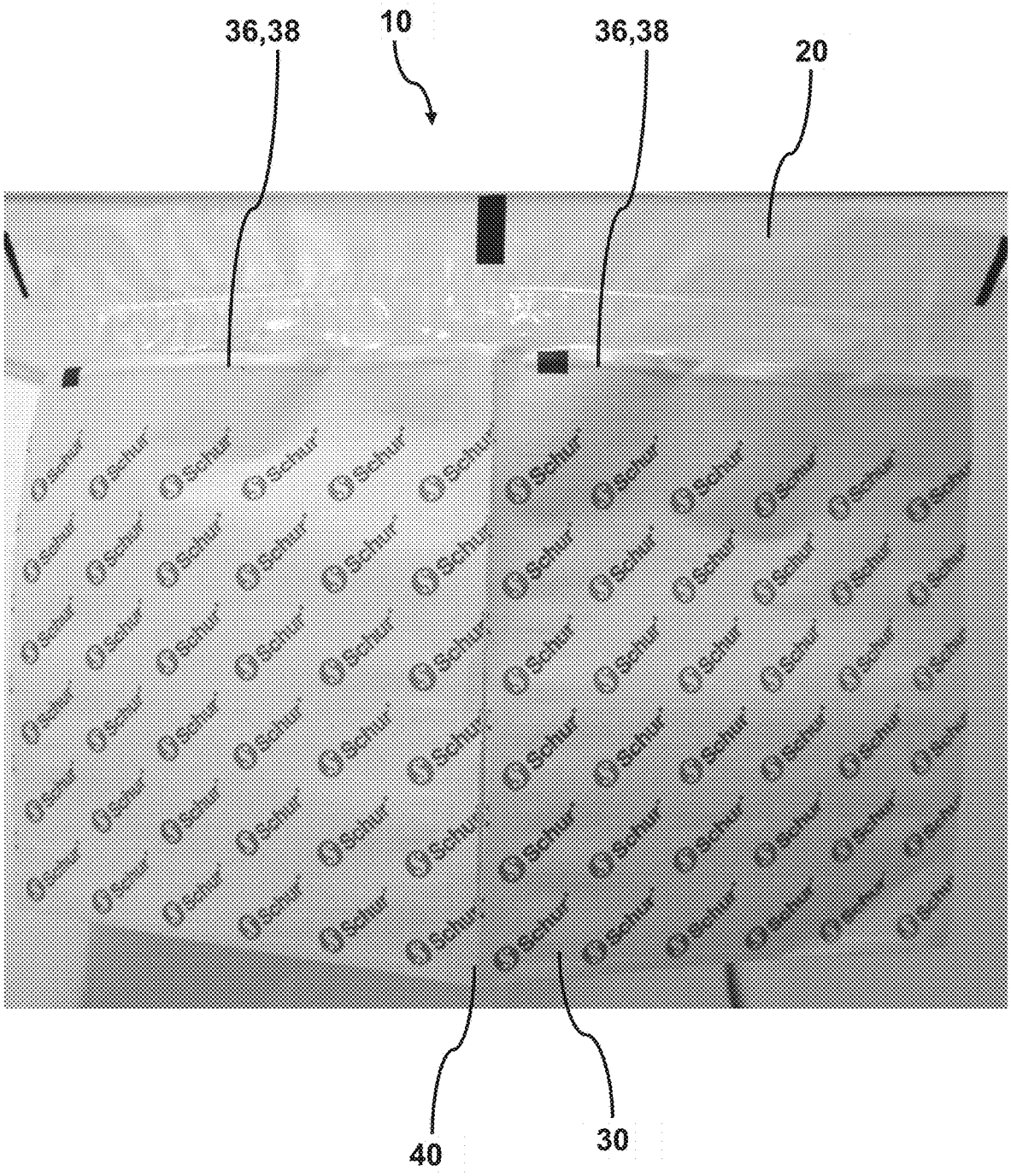
FIG. 9 illustrates another embodiment of a web of bags.

FIG. 9 illustrates another embodiment of a web of bags 10. The web of bags 10 are configured to be guided through a filling station 80, the web of bags 10 comprising a continuous guide 20 of a guide material 22 being a plastic material. The guide 20 is configured to be guided through the filling station 80.

The guide 20 is connected with one or more bags 30 of a bag material 32 being paper.

The one or more bags 30 have bag openings 34 for receiving content.

The bag of webs 10 is disclosed with only two bags 30, however it could in effect be endless.

The skilled person would know that the logo "Schur" is irrelevant for embodiments of the invention as the logo has no technical contribution.

Figure 10:
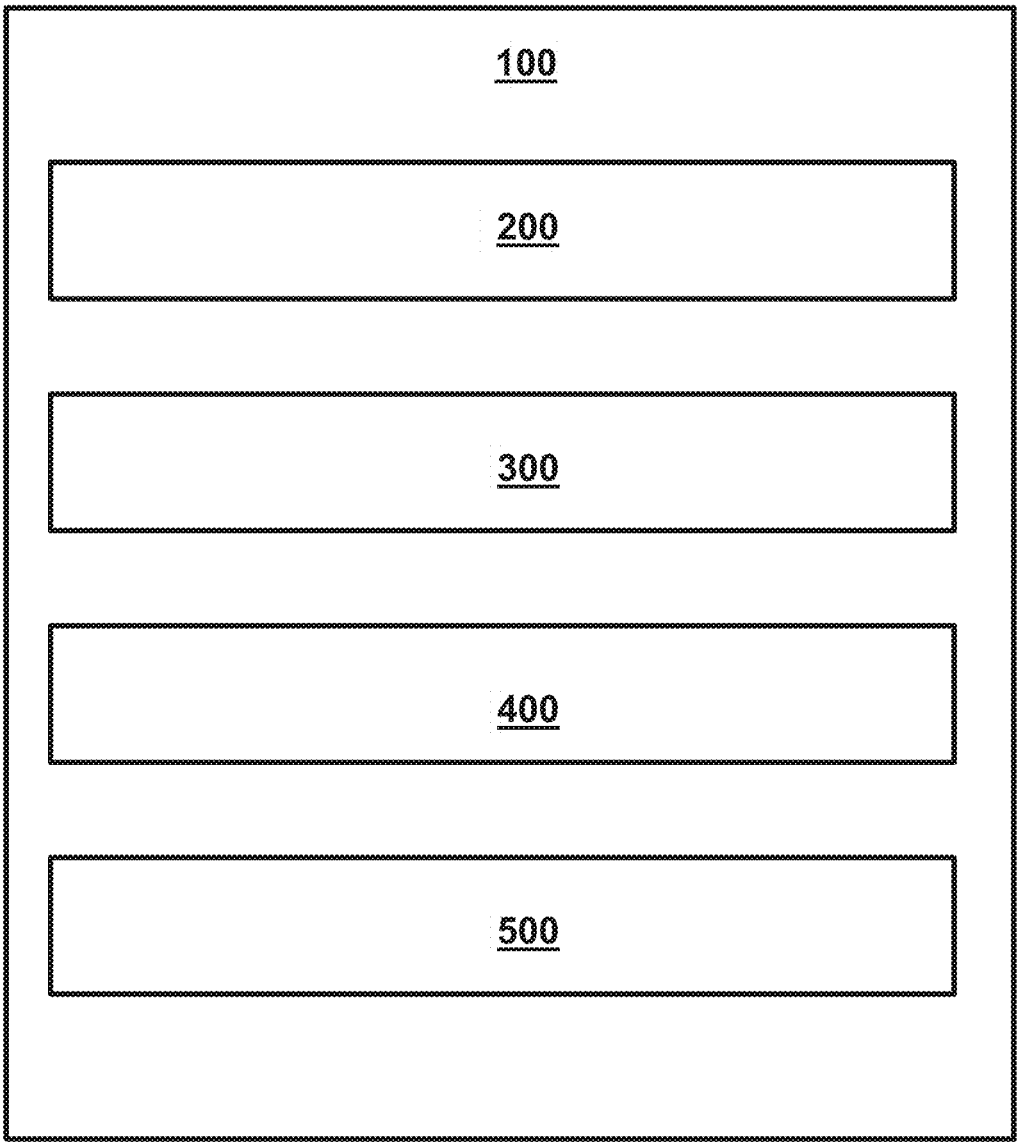
FIG. 10 illustrates a method of filling a bag with content.

FIG. 10 illustrates a method of filling a bag 100.

The method 100 comprises an act of providing 200 a web of bags 10 as a continuous guide 20 of a guide material 22 configured to be guided through a filling station 80 and wherein the guide 20 has connected one or more bags 30 of a bag material and with a bag opening 34, wherein the bag material of a different material than the guide material.

Thereby, the guide 20 can be made of a material optimal for interacting with a conveyor system or the like to and from a filling station, while the bag material is chosen for other characteristics such as recyclability.

The method 100 comprises an act of guiding 300 the web of bags 10 though a filling station 80 using the guide 20.

The method 100 comprises an act filling 400 content or articles into one or more bags 30.

The act of filling 400 may be an act performed manually or semi-automatic or full-automatic.

The method 100 comprises disconnecting 500 the one or more bags 30 from the guide 20. Thereby, the resulting bags 30 have little to none residue of guide material.

In an embodiment of the method of filling a bag 100 the guide material is a polymer and the bag material is a paper.

In an embodiment, the paper is recyclable paper. The effect of disconnecting the bags 30 from the guide 20 is that the recyclable paper is not contaminated by the guide material.

The guide material may be polypropylene (PP) or polyethylene (PE) which is unwanted in paper recycling as the material would be a contamination. If left with the bag 30, then the guide material would in effect increase the weight % of additives of the paper without providing any positive effect.

Figure 11:
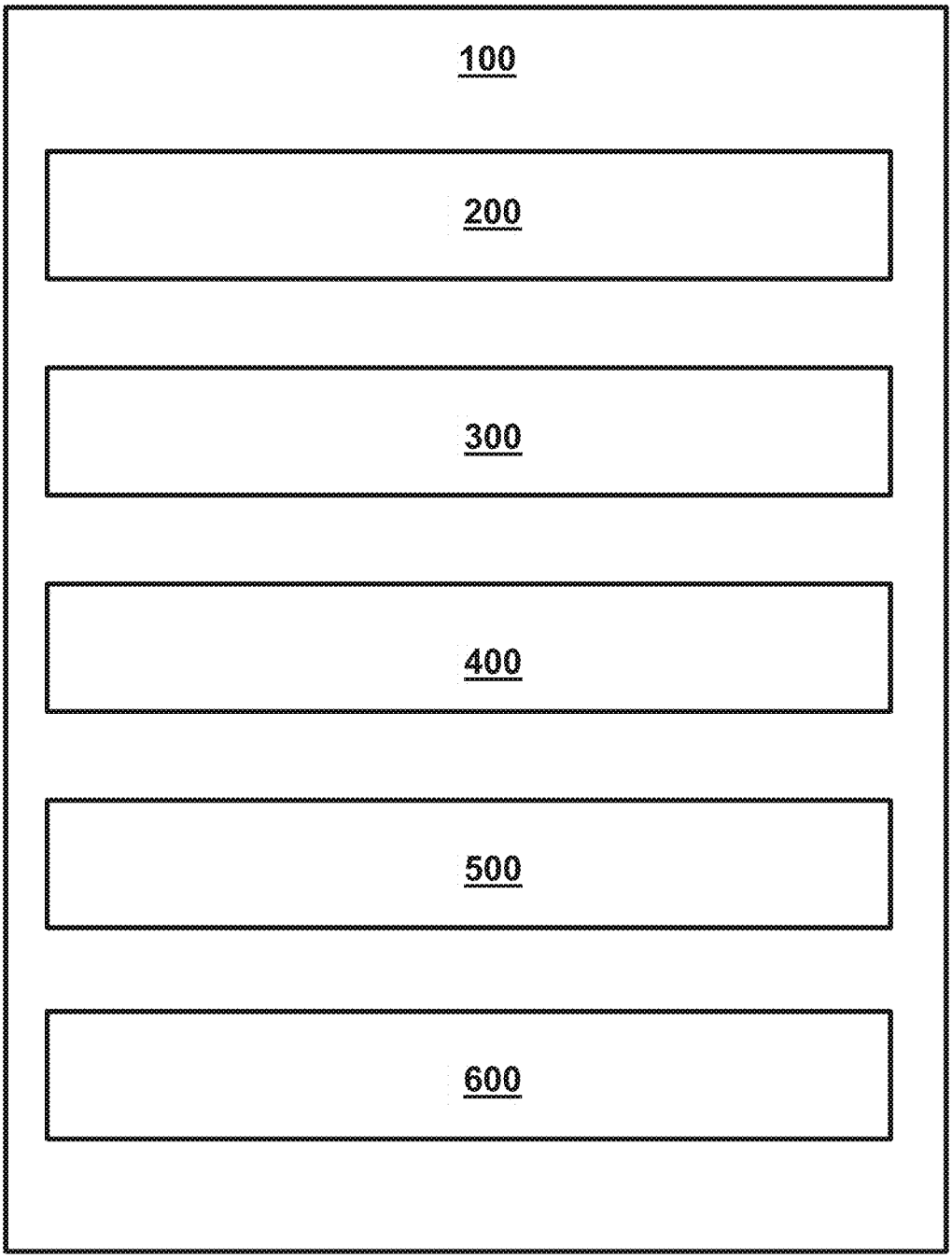
FIG. 11 illustrates a process of producing a bag.

FIG. 11 illustrates a process of producing a bag 30.

The bag 30 with content is by a process 100 comprising an act of providing 200 a web of bags 10 as a continuous guide 20 of a guide material configured to be guided through a filling station 80 and wherein the guide 20 has connected one or more bags 30 of a bag material and with a bag opening 34. The bag material is less flexible than the guide material and the bag material is paper with a sheet weight of 30-150 g/m2, such as 60-70 g/m2 and the paper is pure paper comprising no more than a certain weight % of additives, such as less than or equal to 5 weight %, 20 weight % or 50 weight %.

A weight % of additives less than or equal to 20 weight % is desired over 50 weight % as the resulting paper bag 30 will be deemed recyclable in some countries.

A weight % of additives less than or equal to 5 weight % is most desired as the resulting paper bag 30 will be deemed recyclable/disposable in the EU.

The process 100 may further comprise an act of guiding 300 the web of bags 10 though a filling station 80 in the guide 20.

The process 100 may further comprise an act of filling 400 content into one or more bags 30.

The act of filling 300 may be performed manually or semi-automatic or full-automatic.

The process 100 may further comprise an act disconnecting 500 the one or more bags 30 from the guide 20. Thereby, the resulting bag 30 is not contaminated by the guide material and this makes it easier to have low weight % of additives.

The guide material may be polypropylene (PP) or polyethylene (PE) which is unwanted in paper recycling as the material would be a contamination. If left with the bag 30, then the guide material would in effect increase the weight % of additives of the paper without providing any positive effect.

The process 100 may further comprise an act of closing 600 the bag 30. The act of closing the bag may be performed by splicing or by stitching.

In another embodiment a bag with content is produced by a process 100. The process 100 comprises an act of providing 200 a web of bags 10 as a continuous guide 20 of a guide material configured to be guided through a filling station 80. The guide has connected one or more bags 30 of a bag material and with a bag opening 34, wherein the bag material is less flexible than the guide material. The bag 30 is attached to the guide 20 by way of a splicing defining a splicing path 38 and wherein the bag 30 and the guide are connected along at least part of the splicing path 38.

The process 100 further comprises an act of guiding 300 the web of bags 10 though a filling station 80 by the guide 20.

The process 100 further comprises an act of filling 400 content into one or more bags 30. The act of filling 300 may be performed manually or semi-automatic or full-automatic.

The process 100 further comprises an act of disconnecting 500 the one or more bags 30 from the guide 20 leaving at least part of the guide material along the slicing path 38 on the paper bag 30.

The process 100 further comprises an act of closing 600 the bag 30 by splicing the left guide material on the paper bag 30. Thereby, part of the guide 20 is used for closing the bag, thereby simplifying the process.

The bag material may be paper and the filling station is configured to guide a web of bags with a polymer guide.

FIG. 12 illustrates two different embodiments of guides 20.

FIG. 12A discloses a guide 20 connected to a bag 30. The guide 20 comprises two channels for being guided through a system comprising a filling station.

The guide 20 is made of a guide material being a plastic material such as polypropylene (PP) and polyethylene (PE).

The bag 30 is made of a bag material being paper. The bag 30 near the bag opening 34 is provided with a print 36, which enables the bag material to be connected to the guide material by splicing along the print 36. Thus, the print 36 defines the splicing path 38.

FIG. 12B discloses an embodiment of a guide 20 of the kind shown in FIG. 3B.

The guide 20 is connected to a bag 30. The guide 20 comprises two flaps having perforations for engaging with studs for being guided through a system comprising a filling station. One of the flaps is standing upwardly and one of the flaps is extending downwardly towards the bottom of the bag 30.

The guide 20 is made of guide material being a plastic material such as polypropylene (PP) and polyethylene (PE).

The bag 30 is made of a bag material being paper as exemplified. The bag 30 near the bag opening 34 is provided with a print 36 (not shown), which enables the bag material to be connected to the guide material by splicing along the print 36. Thus, the print 36 defines the splicing path 38. This is shown in great detail in FIG. 8B along the hatched line.

FIG. 13 illustrates two embodiments of a web of bags 10 made of a fibrous material.

Figure 13A:
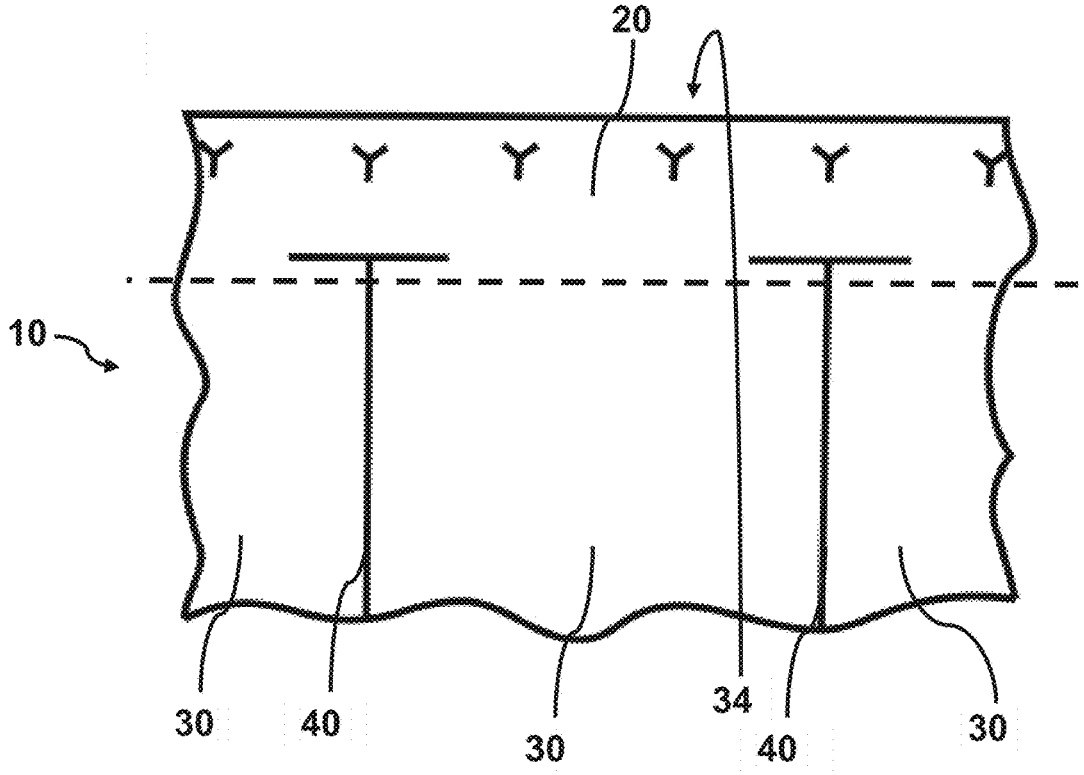
FIG. 13A illustrates an embodiment of a web of bags made of a fibrous material.

FIG. 13A discloses web of bags 10 configured to be guided through a filling station 80, the web of bags 10 comprising a continuous guide 20 of a guide material configured to be guided through a filling station 80. The guide 20 is connected with one or more bags 30 of a bag material and with a bag opening 34.

The bag material comprises the same material as the guide material, wherein the bag material and guide material is selected amongst fibrous materials such as paper. The transition between the guide 20 and the bags 30 is a smooth transition which has been indicated by a dashed line.

The one or more bags 30 are separated along a T-shaped separation line 40. The T-shaped separation 40 enables that the bags can be individually displaced.

The guide 30 has perforations in a longitudinal direction for engaging with studs in a system for conveying the web of bags 10 through a filling station 80.

Figure 13B:
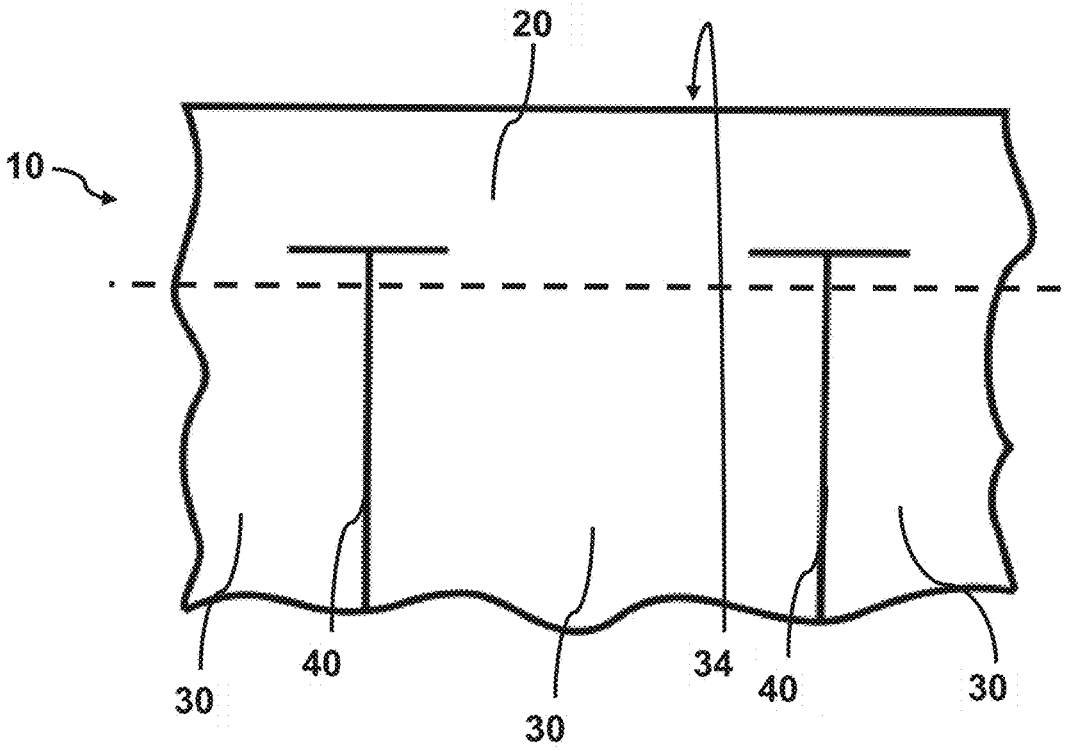
FIG. 13B illustrates an embodiment of a web of bags made of a fibrous material.

FIG. 13B discloses web of bags 10 configured to be guided through a filling station 80, the web of bags 10 comprising a continuous guide 20 of a guide material configured to be guided through a filling station 80. The guide 20 is connected with one or more bags 30 of a bag material and with a bag opening 34.

The bag material comprises the same material as the guide material, wherein the bag material and guide material is selected amongst fibrous materials such as paper. The transition between the guide 20 and the bags 30 is a smooth transition which has been indicated by a dashed line.

The one or more bags 30 are separated along a T-shaped separation line 40. The T-shaped separation 40 enables that the bags can be individually displaced.

Figure 14:
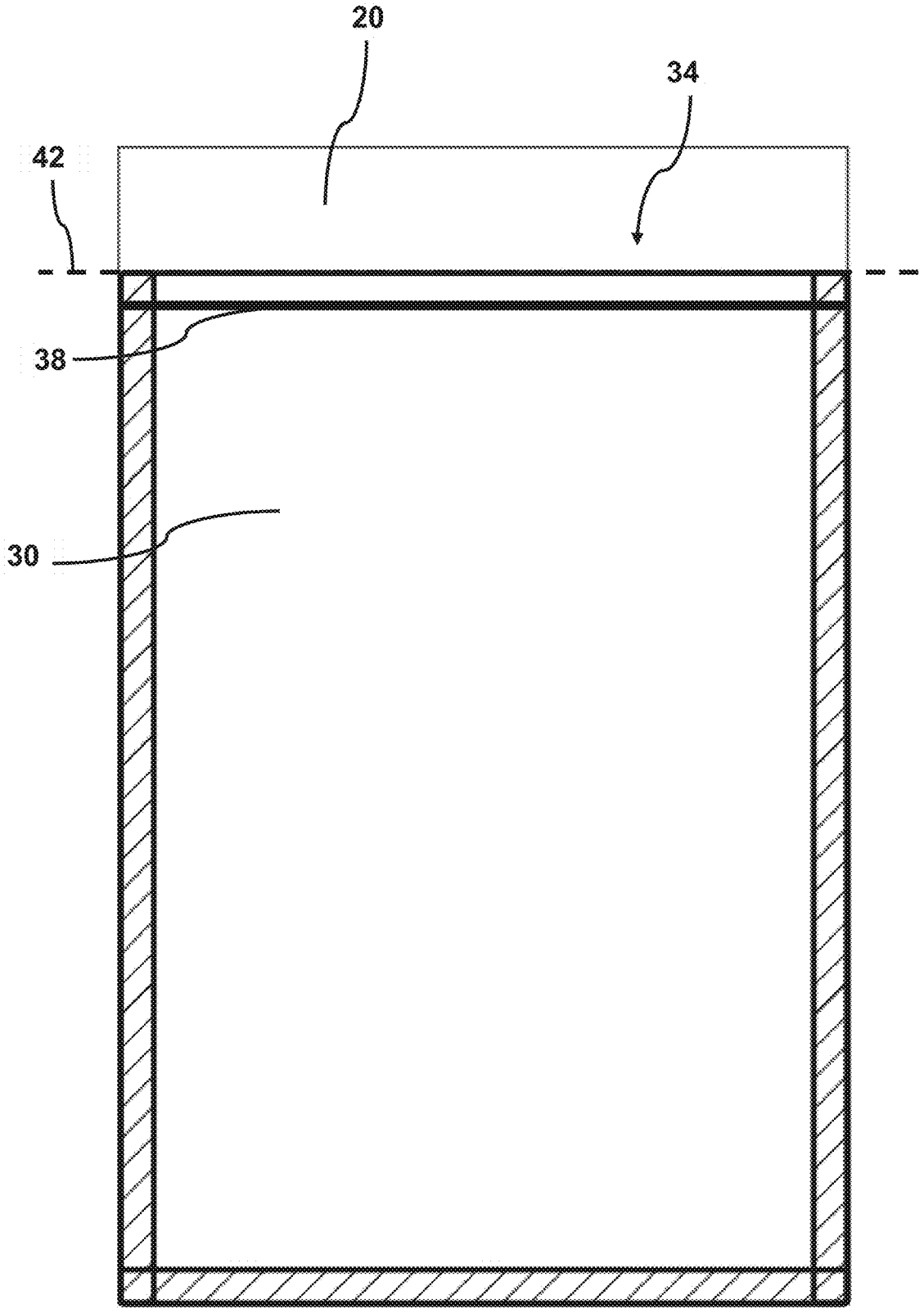
FIG. 14 illustrates a bag made of a fibrous material.

FIG. 14 illustrates a bag 30 made of a fibrous material having a bag opening 34. In this case the bag 30 is still connected to a guide 20.

The guide 20 is to be removed by cutting along a cut path 42 and the bag can afterwards be closed along a splicing path by splicing or by stitching or by any other closing means.

Figure 15:
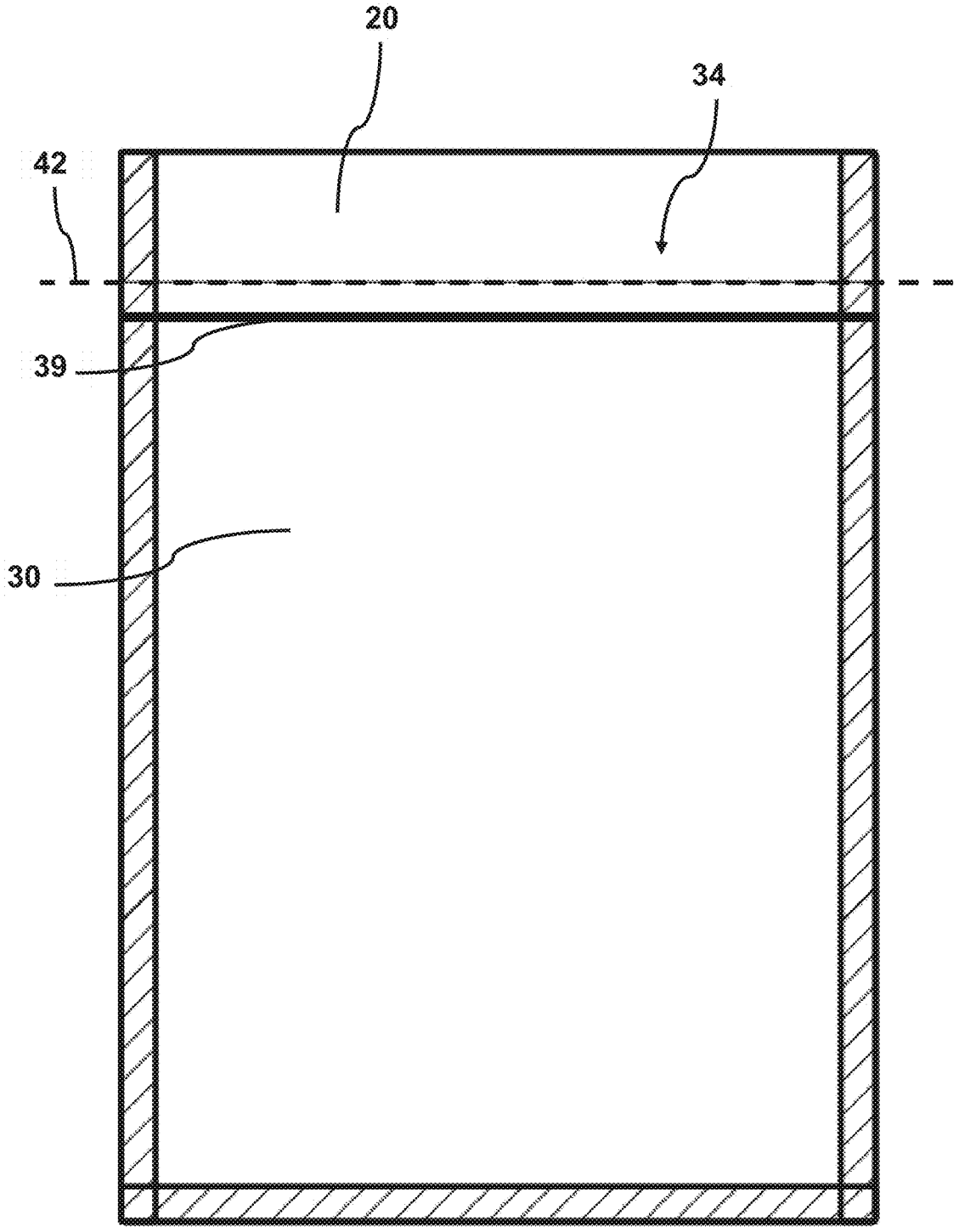
FIG. 15 illustrates another bag made of a fibrous material.

FIG. 15 illustrates another bag 30 made of a fibrous material having a bag opening 34. In this case the bag 30 is still connected to a guide 20.

The guide 20 is to be removed by cutting along a cut path 42 and the bag can afterwards be closed along a splicing path by splicing or by stitching or by any other closing means.

Although the present invention has been disclosed in the form of embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. A web of bags configured to be guided through a filling station, the web of bags comprising:

a continuous guide of a guide material configured to be guided through the filling station and wherein the guide is connected with one or more bags of a bag material and with a bag opening, wherein the bag material is of a different material than the guide material, wherein the bag material is selected amongst fibrous materials including paper or metallic foils, and wherein the guide material is selected from polymer or plastic including polypropylene or polyethylene.

2. The web of bags according to claim 1, wherein the guide material is a polymer and the bag material is a paper.

3. The web of bags according to claim 1, wherein at least one or more of the bags is attached to the guide by a splicing and wherein the bag material is prepared with a print defining a splicing path and wherein the bag and the guide are connected along at least part of the splicing path.

4. The web of bags according to claim 3, wherein the print on the bag is made by a lacquer or a glue.

5. The web of bags according to claim 1, wherein the guide is connected to the one or more bags on the inside of the one or more bags substantially along the bag opening of the one or more bags.

6. The web of bags according to claim 1, wherein the paper is pure paper comprising no more than a certain weight % of additives, including less than or equal to 5 weight %, 20 weight % or 50 weight %.

7. The bag according to claim 1, wherein the bag material is paper and the filling station is configured to guide a web of bags with a polymer guide.

8. A method of filling a bag with content, the method comprising:

providing a web of bags with a continuous guide of a guide material configured to be guided through the filling station and wherein the guide has connected one or more bags of a bag material and with a bag opening, wherein the bag material is different than the guide material, wherein the bag material is selected amongst fibrous materials including paper or metallic foils, and wherein the guide material is selected from polymer or plastic including polypropylene or polyethylene;

guiding the web of bags though a filling station in the guide;

filling content into one or more bags; and disconnecting the one or more bags from the guide.

9. The method of filling a bag according to claim 8, wherein the guide material is a polymer and the bag material is a paper.

10. A bag with content produced by a process of providing a web of bags with a continuous guide of a guide material configured to be guided through the filling station and wherein the guide has connected one or more bags of a bag material and with a bag opening, wherein the bag material is different than the guide material, wherein the bag material is paper, and wherein the guide material is selected from polymer or plastic including polypropylene or polyethylene; wherein the bag is attached to the guide by way of a splicing defining a splicing path and wherein the bag and the guide are connected along at least part of the splicing path;

guiding the web of bags through a filling station in the guide;

filling content into one or more bags;

disconnecting the one or more bags from the guide leaving at least part of the guide material along the slicing path on the bag; and closing the bag by splicing the guide material left on the bag.

11. A bag with content produced by a process of providing a web of bags with a continuous guide of a guide material configured to be guided through the filling station and wherein the guide has connected one or more bags of a bag material and with a bag opening, wherein the bag material is different than the guide material; wherein the bag material is paper which is 30-150 g/m2, such as 60-70 g/m2 and the paper is pure paper comprising no more than a certain weight % of additives, including less than or equal to 5 weight %, 20 weight % or 50 weight %, wherein the guide material is selected from polymer or plastic including polypropylene or polyethylene;

guiding the web of bags though a filling station in the guide;

filling content into one or more bags;

disconnecting the one or more bags from the guide leaving at least part of the guide material along a splicing path on the paper bag; and closing the bag.

12. Use of a web of bags in a filling station, wherein the filling station is configured to guide a web of bags with a guide of a flexible material and to fill bags, wherein the web of bags comprises bags of a bag material different than the guide material, wherein the bag material is selected amongst fibrous materials including paper or metallic foils, and wherein the guide material is selected from polymer or plastic including polypropylene or polyethylene.

13. Use of a web of bags according to claim 12, wherein the web of bags is configured to be guided through a filling station, the web of bags comprising:

a continuous guide of a guide material configured to be guided through the filling station and wherein the guide is connected with one or more bags of a bag material and with a bag opening, wherein the bag material is of a different material than the guide material.

* * * * *